US006758621B2

(12) United States Patent
To

(10) Patent No.: US 6,758,621 B2
(45) Date of Patent: Jul. 6, 2004

(54) RING BINDER MECHANISM

(75) Inventor: Chun Yuen To, Kauto Shan Shatin N.T. (HK)

(73) Assignee: World Wide Stationery Manufacturing Company, Ltd., Hong Kong (CH)

( * ) Notice: Subject to any disclaimer, the term of this patent is extended or adjusted under 35 U.S.C. 154(b) by 0 days.

(21) Appl. No.: 09/921,842

(22) Filed: Aug. 3, 2001

(65) Prior Publication Data

US 2003/0026643 A1 Feb. 6, 2003

(51) Int. Cl.[7] ..... B42F 3/02

(52) U.S. Cl. ..... 402/19; 281/31; 402/26; 402/38; 402/41; D19/26

(58) Field of Search ..... 402/26, 31, 36, 402/37, 38, 39, 41, 19; D19/26, 27; 281/31

(56) References Cited

U.S. PATENT DOCUMENTS

| | | | | | |
|---|---|---|---|---|---|
| 3,263,687 | A | | 8/1966 | Weichert | |
| 4,552,478 | A | | 11/1985 | Cohen | |
| 5,106,222 | A | * | 4/1992 | D'Amore | 402/26 |
| D377,805 | S | | 2/1997 | To | |
| D382,593 | S | | 8/1997 | To | |
| D408,851 | S | | 4/1999 | To | |
| 5,971,649 | A | | 10/1999 | To | |
| 5,980,146 | A | | 11/1999 | To | |
| 6,045,286 | A | * | 4/2000 | Tung | 402/26 |
| D426,571 | S | | 6/2000 | To | |
| D433,445 | S | | 11/2000 | To | |
| D434,071 | S | | 11/2000 | To | |
| 6,142,697 | A | * | 11/2000 | Williams | 402/26 |
| 6,217,247 | B1 | | 4/2001 | Ng | |

* cited by examiner

*Primary Examiner*—Monica S. Carter
(74) *Attorney, Agent, or Firm*—Senniger, Powers, Leavitt & Roedel

(57) ABSTRACT

A ring binder mechanism adapted to be secured to a base member, and having a substantially rigid upper member having a substantially straight lateral edge along substantially its entire length and wherein the upper member supports a pair of pivotable lower members to which a plurality of pairs of respective half-ring members are secured and wherein the pivotable members are pivotably movable between a first position in which the pairs of half-ring members are closed and a second position in which the pairs of half-ring members are open and wherein at least one of the half-ring members of each pair has a lower portion disposed outwardly of and closely adjacent the lateral edge of the upper member when the pairs of half-ring members are in the first position.

16 Claims, 16 Drawing Sheets

RING BINDER MECHANISM

The present invention relates to a ring binder mechanism which is secured to a base member, such as a cardboard cover, to form a storage device of the note-book type for storing loose-leaf pages, such as the commonly known three-ring binder.

BACKGROUND OF THE INVENTION

Conventional ring binder mechanisms are generally constructed of a substantially rigid elongated upper member or housing supporting a pair of plates mounted for pivotal movement within the housing with each plate carrying a plurality of half-rings, commonly three. Each half-ring on one plate is aligned with a similar half-ring on the other plate so that in a closed position the half-rings form a closure, generally circular or D-shaped in configuration, for holding a plurality of loose-leaf pages within a binder or base member to which the binder mechanism is secured. Commonly, the half-rings in conventional ring binders extend up through openings or slots formed in the binder upper member or housing such that loose-leaf pages mounted to the half rings through holes adjacent the pages' edges rest on the upper surface of the housing, as is shown for example in U.S. Pat. No. 5,971,649. In addition, some conventional ring binder mechanisms have their half-rings mounted so as to extend around the lateral edges of the housing and outward a sufficient distance that the loose-leaf pages rest on a relatively horizontal portion of the half-rings such that the edges of the paper do not touch the housing, as is shown for example in U.S. Pat. Nos. 3,263,687 and 4,552,478. It is also common to use such ring binder mechanisms either attached to the spine of the cover or base member or attached to one side of the cover or base member. Because of the shape of the half-rings and their manner of fastening to and positioning on the binder mechanism in these conventional ring binder mechanisms, the overall dimensions of the cover or base member which must surround them and the loose-leaf pages must be large enough to accommodate these structures as well as provide sufficient clearance between the bottom of the ring binder mechanism and the cover or base to allow the half-rings to be moved to their open position where pages can be inserted. It is desirable to reduce the size of the base member or cover while maximizing and/or maintaining its capacity to hold loose-leaf pages. The present invention is directed to such an endeavor.

SUMMARY OF THE INVENTION

The present invention provides a ring binder mechanism which allows for the reduction in the size of the base member or cover of a binder while maintaining and/or increasing the capacity of the binder for loose-leaf pages. This is achieved by providing a ring binder mechanism adapted to be secured to a base member, comprising a substantially rigid upper member supporting a pair of pivotable lower members to which a plurality of pairs of respective half-ring members are secured and wherein the pivotable members are pivotably movable between a first position in which the pairs of half-ring members are closed and a second position in which the pairs of half-ring members are open and wherein at least one of the half-ring members of each pair has a lower portion adjacent the upper member substantially in abutment with a lateral edge of the upper member when the pairs of half-ring members are in the first position. In addition, the ring binder mechanism preferably further includes the lateral edge of the upper member being straight along substantially the entire length of the upper member. It also preferably includes the at least one of the half-ring members of each pair extends around the lateral edge of the upper member and beneath one of the pair of pivotal members and the at least one of the half-ring members of each pair being secured to a bottom surface of the one of the pair of pivotal members.

DETAILED DESCRIPTION OF THE PREFERRED EMBODIMENTS

Figure 1:
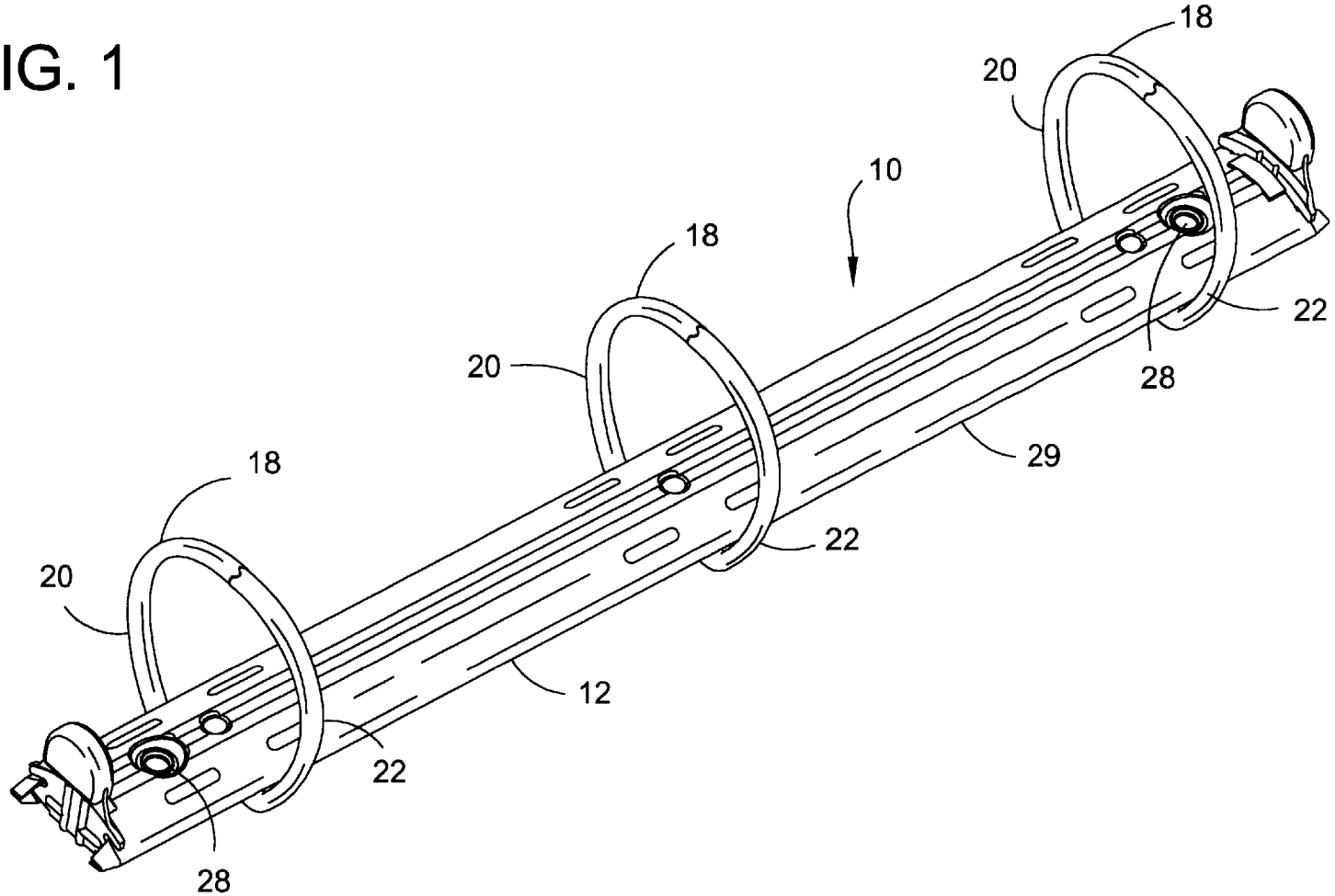
FIG. 1 is a pictorial view showing the upper portion of a first embodiment of a ring binder mechanism of the present invention with the rings in a closed position.
Figure 2:
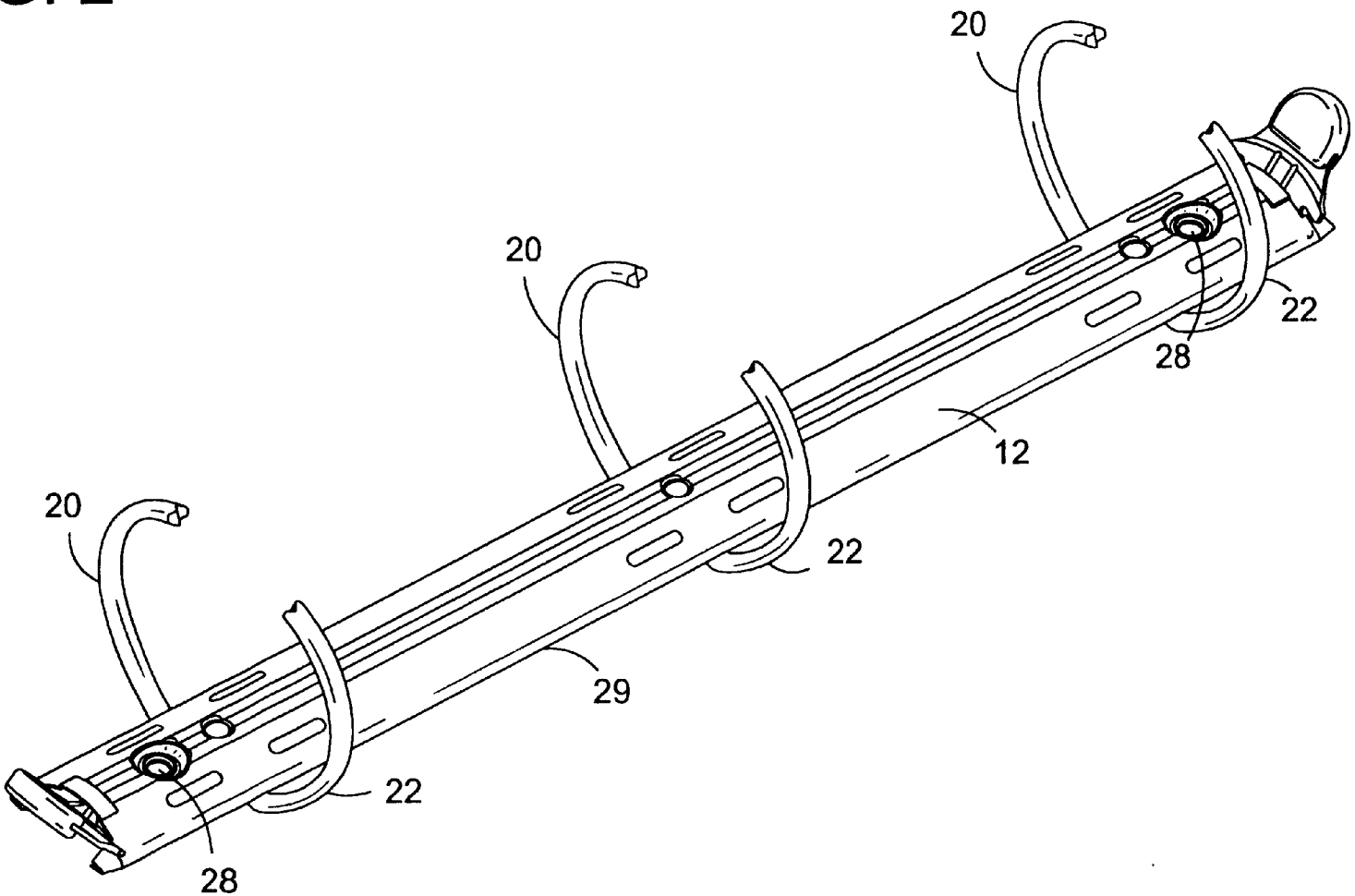
FIG. 2 is a view similar to FIG. 1 with the rings in an open position.
Figure 3:
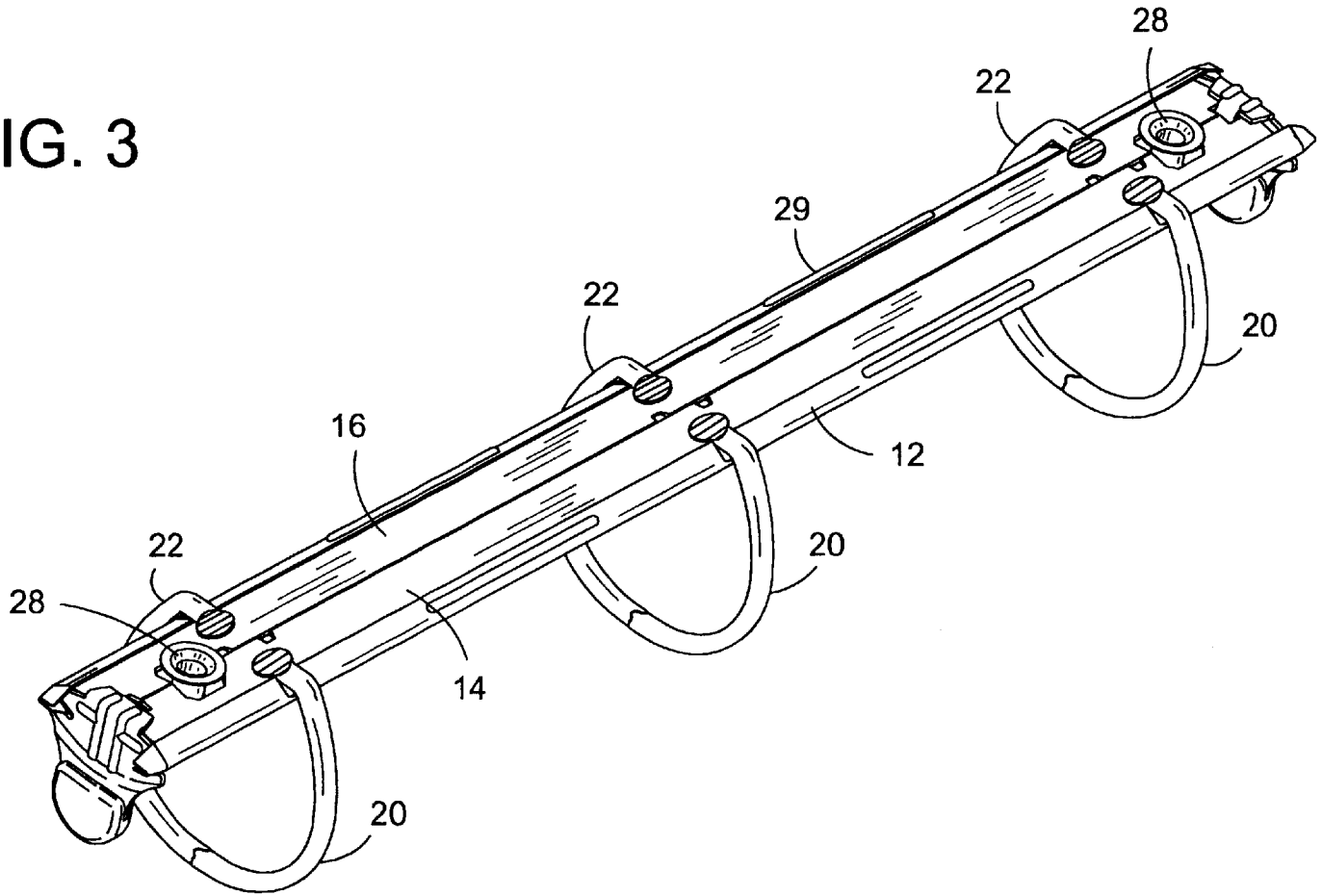
FIG. 3 is a pictorial view showing the bottom of the embodiment of FIG. 1 with the rings in the closed position.
Figure 4:
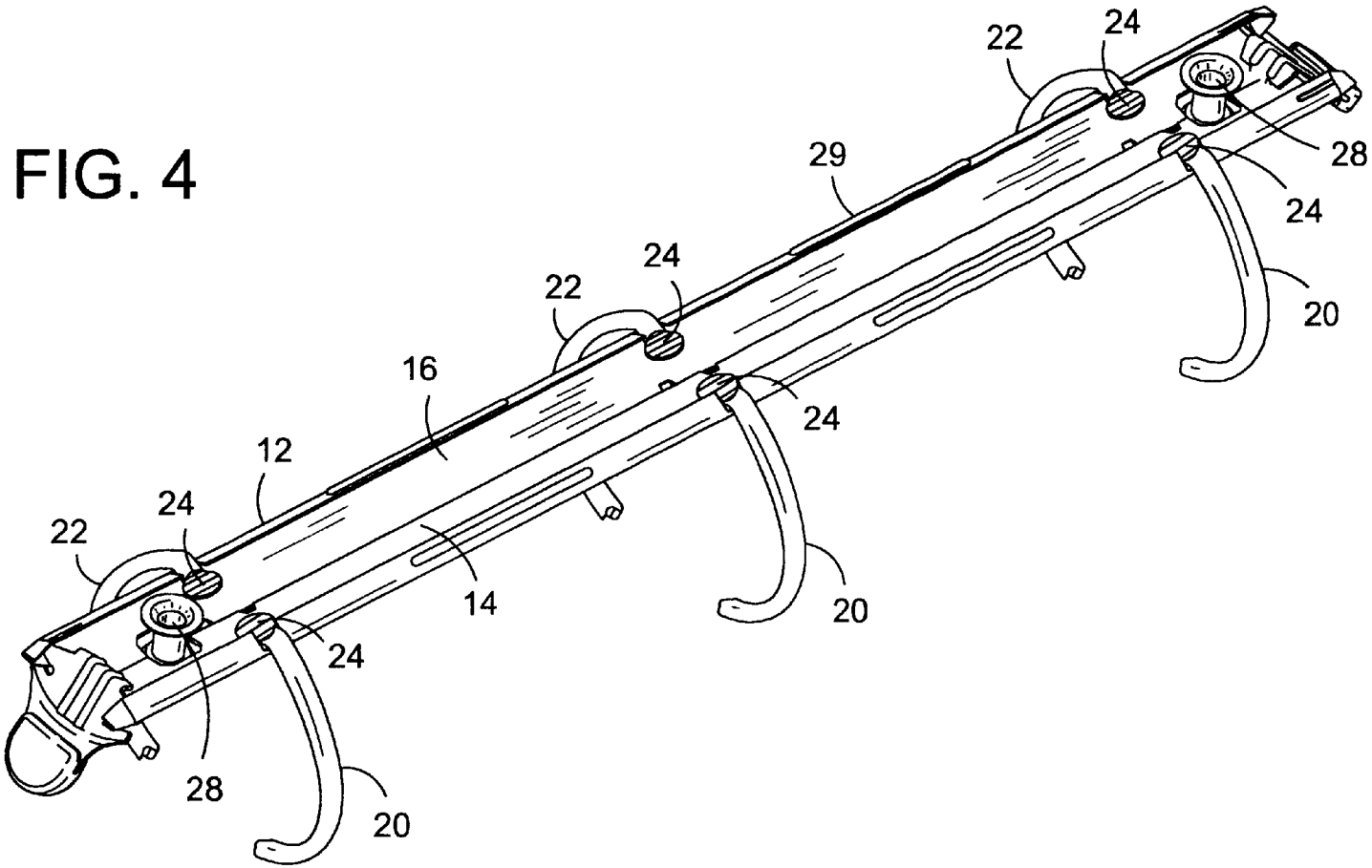
FIG. 4 is a view similar to FIG. 3 with the rings in the open position.

The first embodiment of the ring binder mechanism of the present invention is generally designated 10. The ring binder 10 includes a substantially rigid upper plate member 12 supporting a pair of lower plates 14 and 16, as shown in FIG. 3. Lower plates 14 and 16 are pivotally movable relative to each other to enable the rings 18 to be manually opened or closed in a conventional manner.

Figure 5:
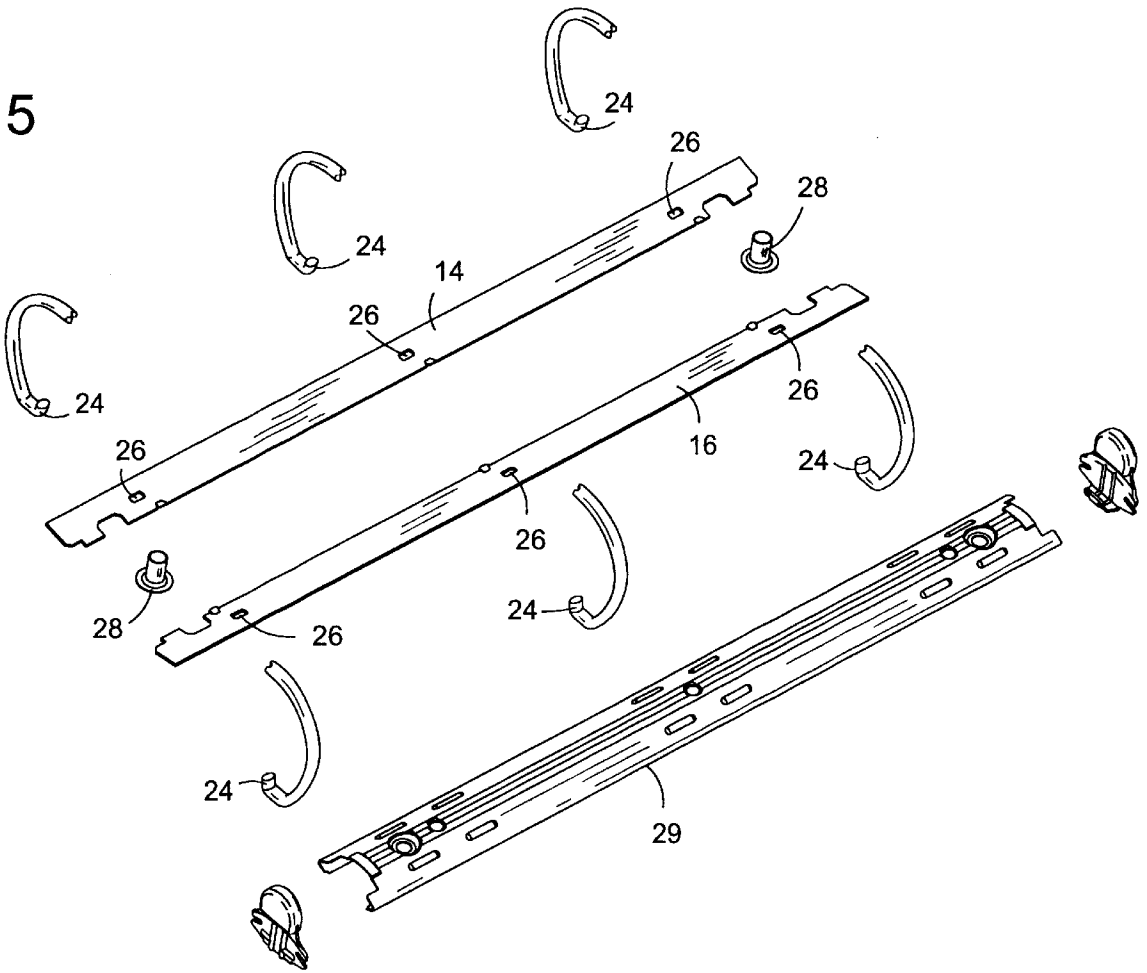
FIG. 5 is an expanded pictorial view of the first embodiment.

Each pair of rings 18 is comprised of two half-ring members 20 and 22. These half-rings are mounted to respective plates 14 and 16, such as by inserting an end 24 (FIG. 5) in an opening 26 and then compressing the end on each side to grip the lower plate 14 or 16. The ring binder mechanism 10 is generally secured to a base member or cover such as by use of rivets 28 or similar structures in a conventional manner.

Figure 7:
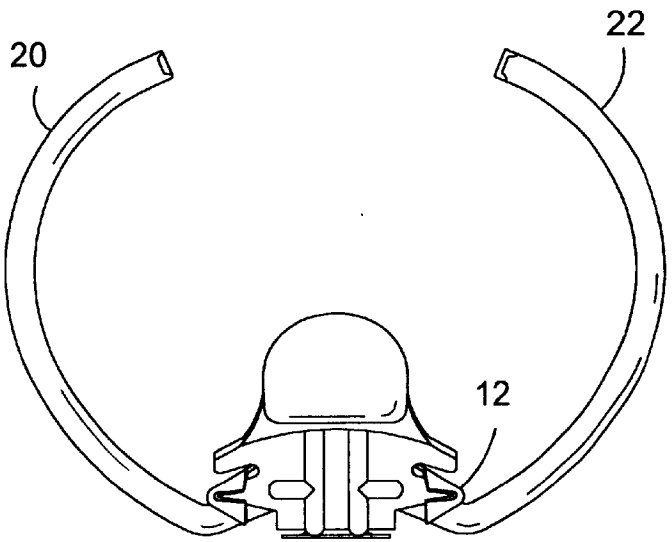
FIG. 7 is a left-end view of the first embodiment with the rings in the open position.
Figure 6:
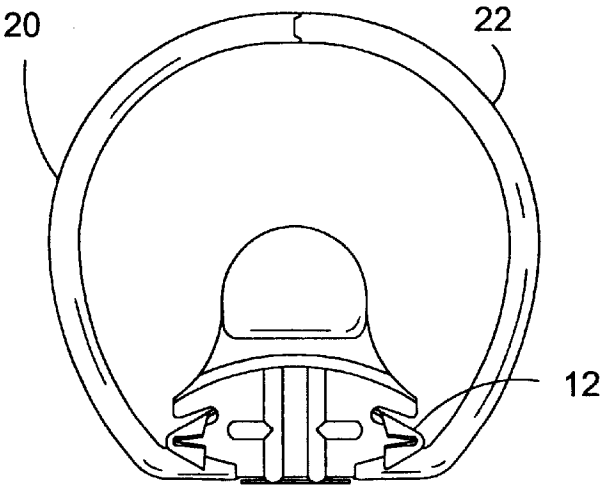
FIG. 6 is a left-end view of the first embodiment with the rings in the closed position.
Figure 8:
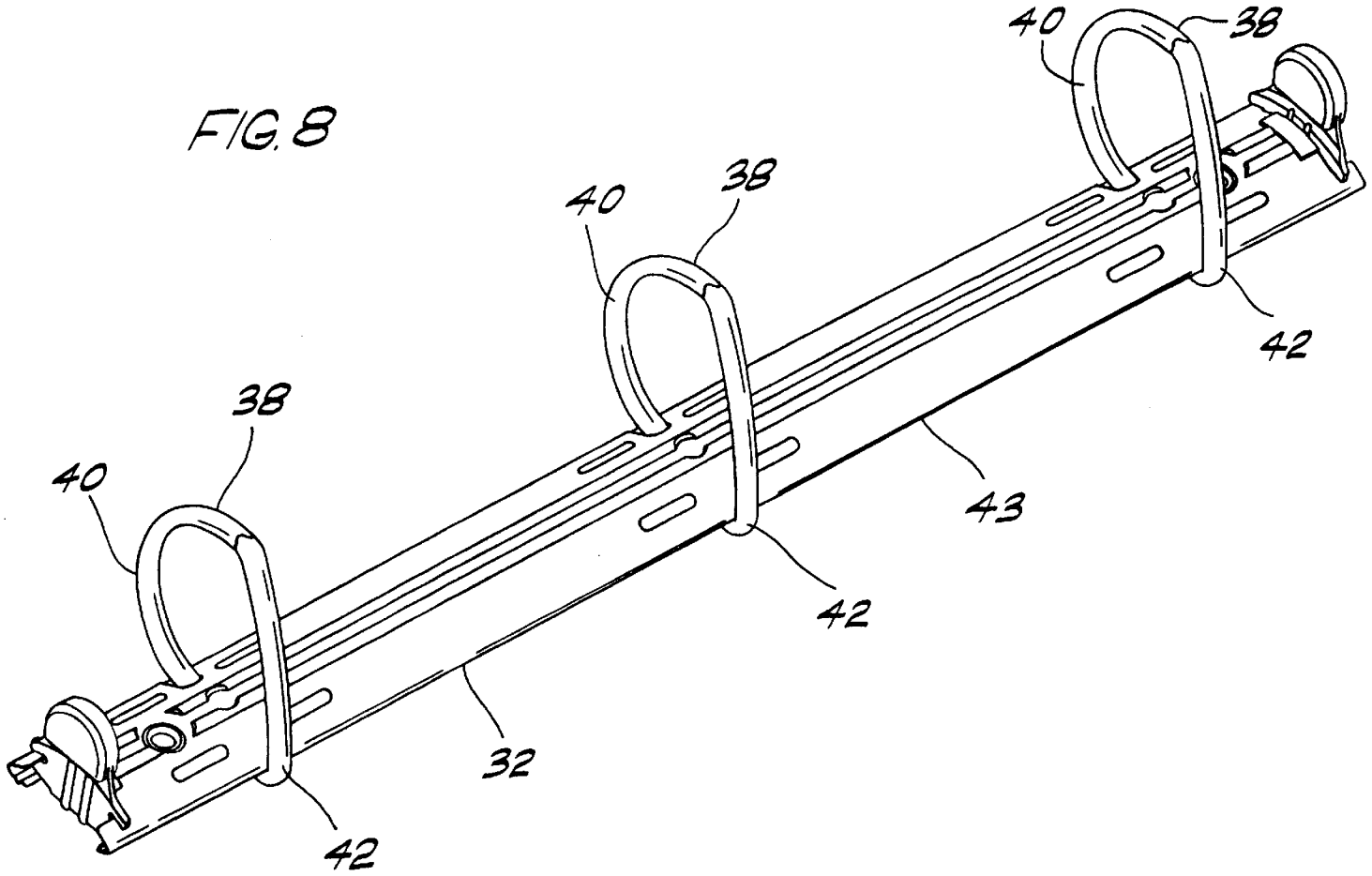
FIG. 8 is a pictorial view showing the upper portion of a second embodiment of the present invention with the rings in the closed position.
Figure 9:
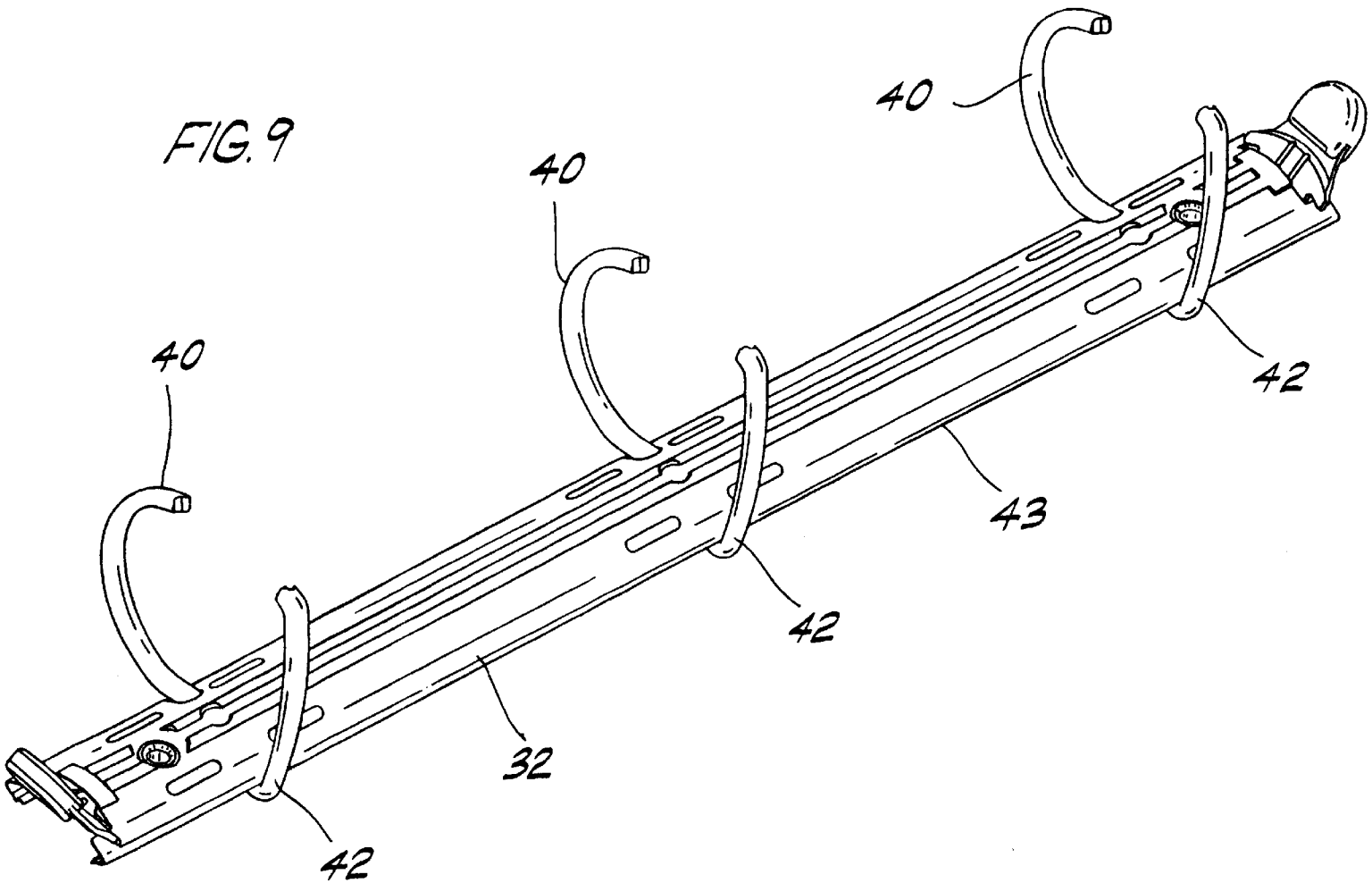
FIG. 9 is a view similar to FIG. 8 with the rings in the open position.
Figure 10:
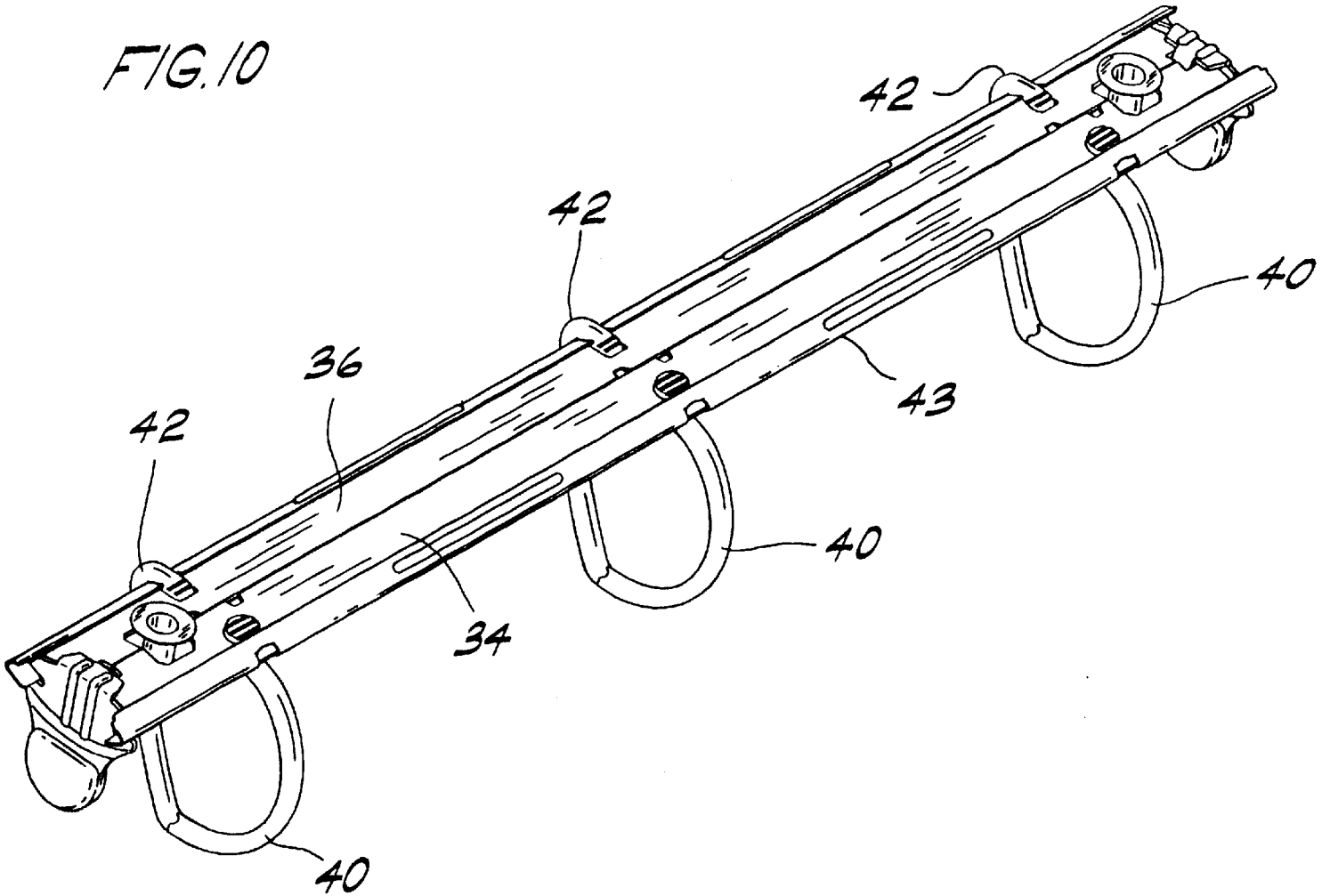
FIG. 10 is a bottom pictorial view of the second embodiment of the present invention with the rings in the closed position.
Figure 11:
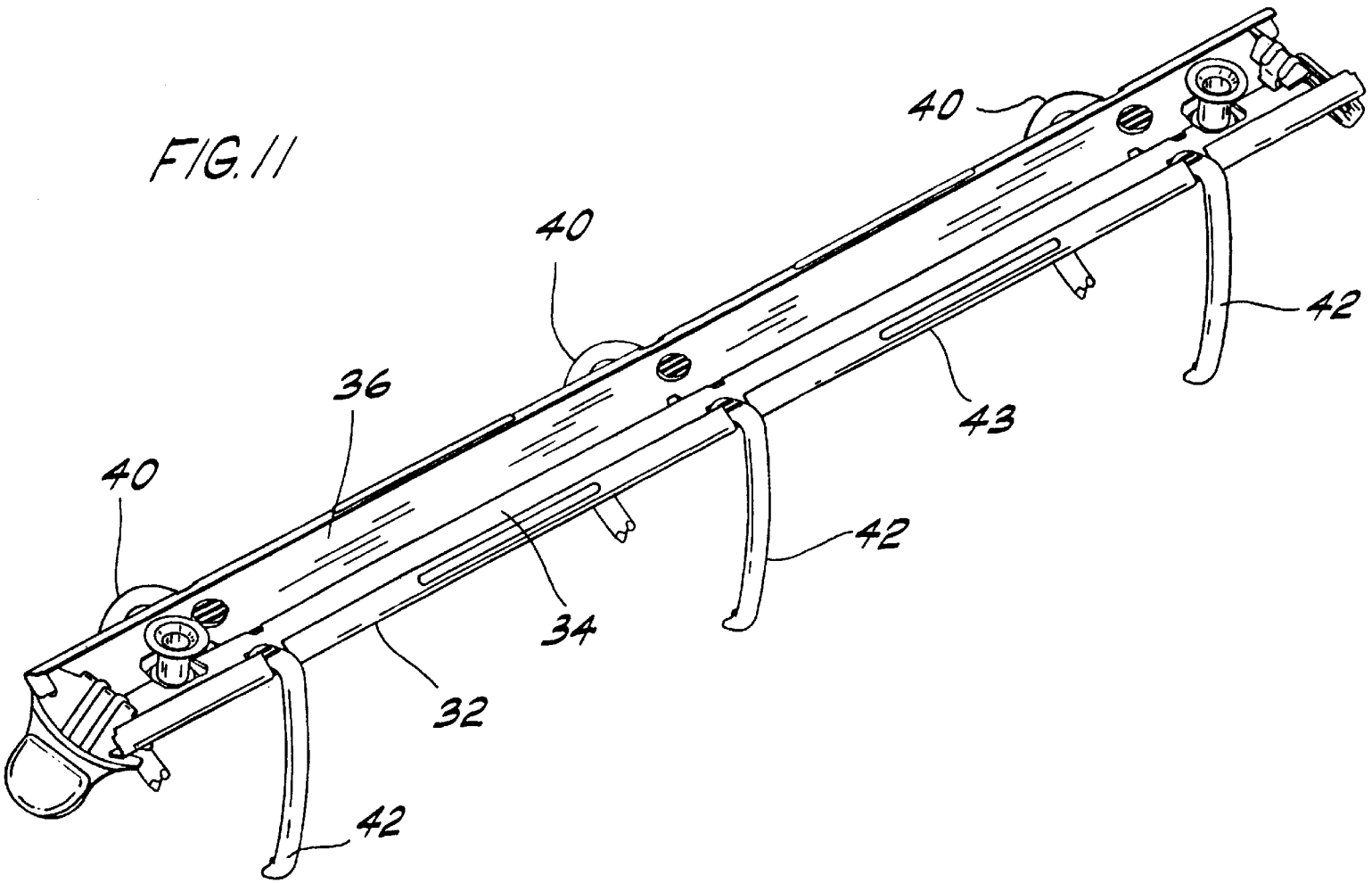
FIG. 11 is a view similar to FIG. 10 with the rings in the open position.
Figure 12:
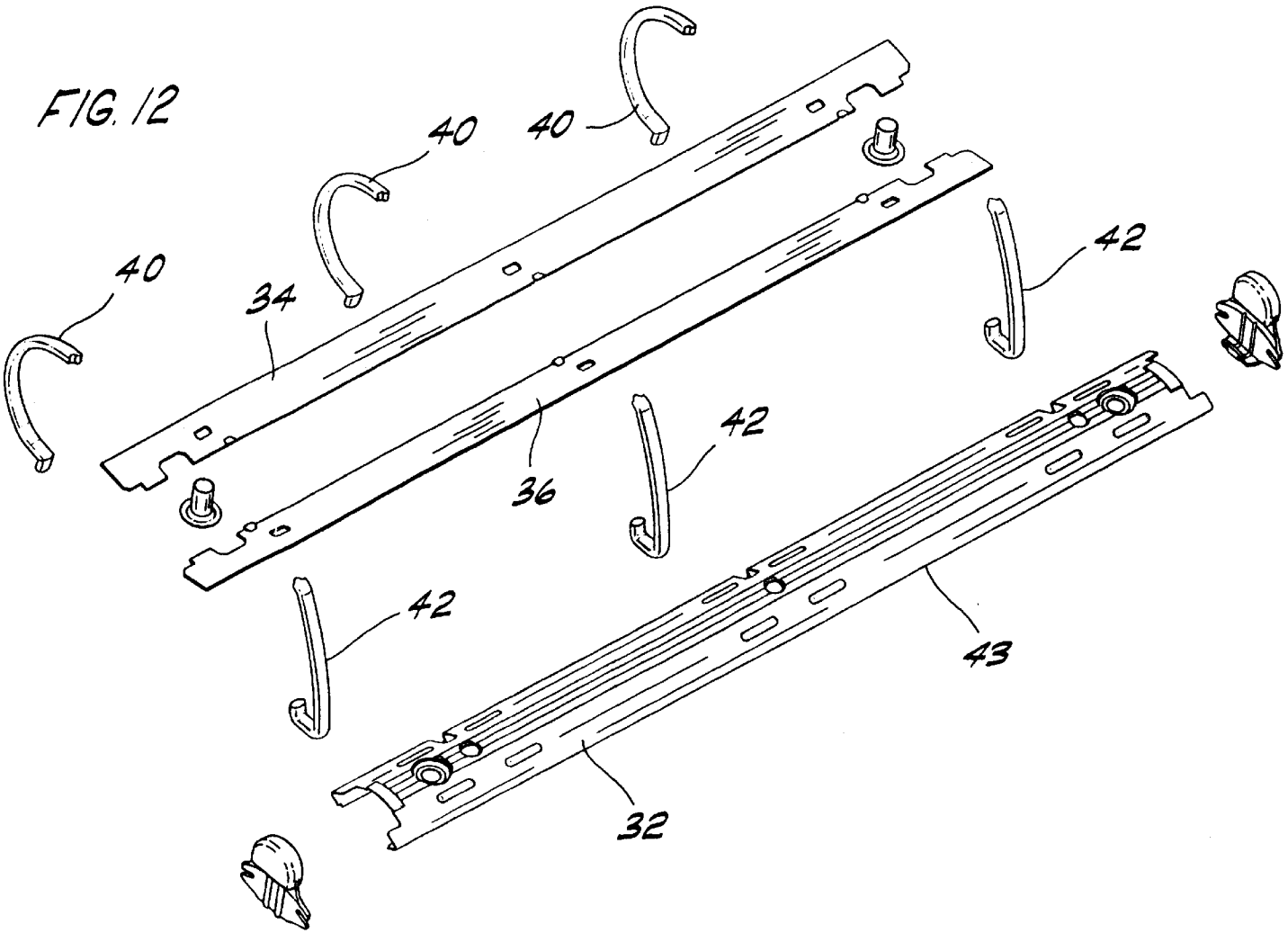
FIG. 12 is an expanded view of the second embodiment of the present invention.

When closed, the rings 18 of the first embodiment form a generally circular ring in appearance wherein each of the half-ring members 20 and 22 are arcuate shaped in the portion extending above the upper plate member 12 as seen in FIG. 6. Unlike conventional ring members, the ring members 18 of the first embodiment of the present invention are constructed and arranged so that a lower portion of each half-ring member 20 and 22 adjacent the lateral edge 29 of the upper member is in substantially abutting relationship thereto. This lower portion of the half-ring member 20 or 22 need not actually touch the lateral edge 29 of the upper plate member 12, but should at least be closely adjacent thereto when the ring members 18 are in their closed or first position as shown in FIG. 6. Likewise, when the rings 18 of the first embodiment are in their open or second position, as shown in FIG. 7, the lower end portion of at least one of the half-ring members 20 or 22 on which the paper is normally positioned is also maintained closely adjacent the lateral edge 29 of upper plate member 12 as seen in FIG. 7. The lateral edge 29 is preferably straight along substantially its entire length.

Referring now to the second embodiment of the present invention, as seen in FIGS. 8 through 14, it is very similar to the first embodiment and is generally designated 30. It is constructed very similar to the first embodiment with an upper plate member 32 of substantially rigid construction and supports a pair of lower plates 34 and 36 which are pivotally movable relative to each other to enable rings 38 to be selectively opened or closed in a conventional manner.

Figure 14:
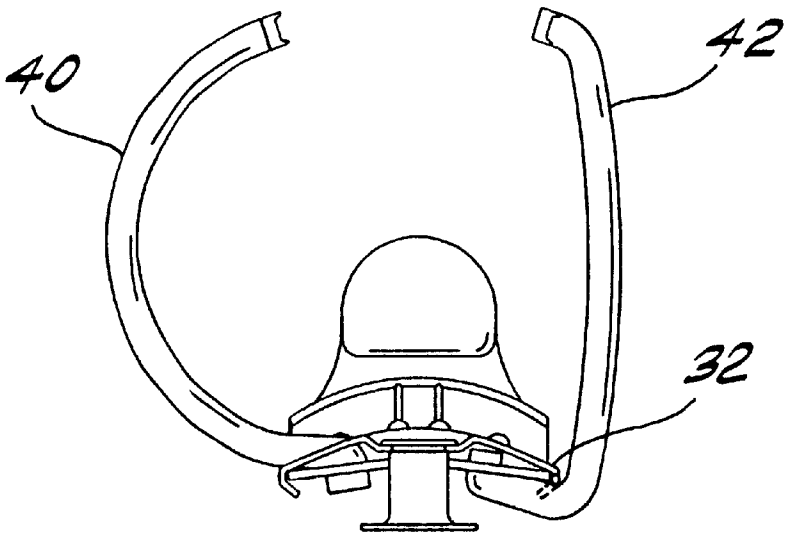
FIG. 14 is a view similar to FIG. 13 with the rings in the open position.
Figure 13:
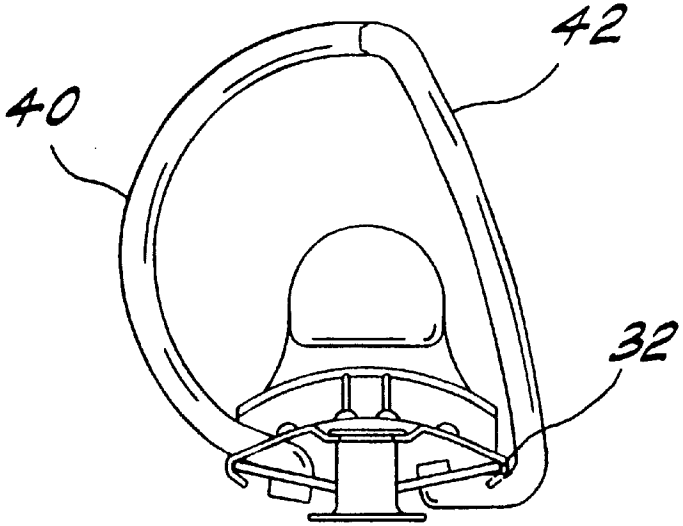
FIG. 13 is a left-end view of the second embodiment with the rings in the closed position.

Each of the rings 38 is constructed of two half-ring members 40 and 42. Half-ring members 40 and 42 are secured to the respective lower plates 34 and 36 in the same manner as the first embodiment. The main difference in the second embodiment from the first embodiment is the shape of the half-ring members 40 and 42 in that in the closed position, as shown in FIG. 13, the rings 38 are of a generally D-shaped configuration wherein the half-ring members 42 are of a generally J-shaped configuration and the half-ring members 40 are generally semi-circular or arcuate. However, as with the first embodiment, the half-ring members 42 are disposed closely adjacent in almost abutting relationship to the lateral edge 43 of the upper plate member 32, as best seen in FIGS. 13 and 14, when in the closed and opened positions respectively. Again, the lateral edge 43, as with the lateral edge 29, is preferably straight along its entire length.

Figure 15:
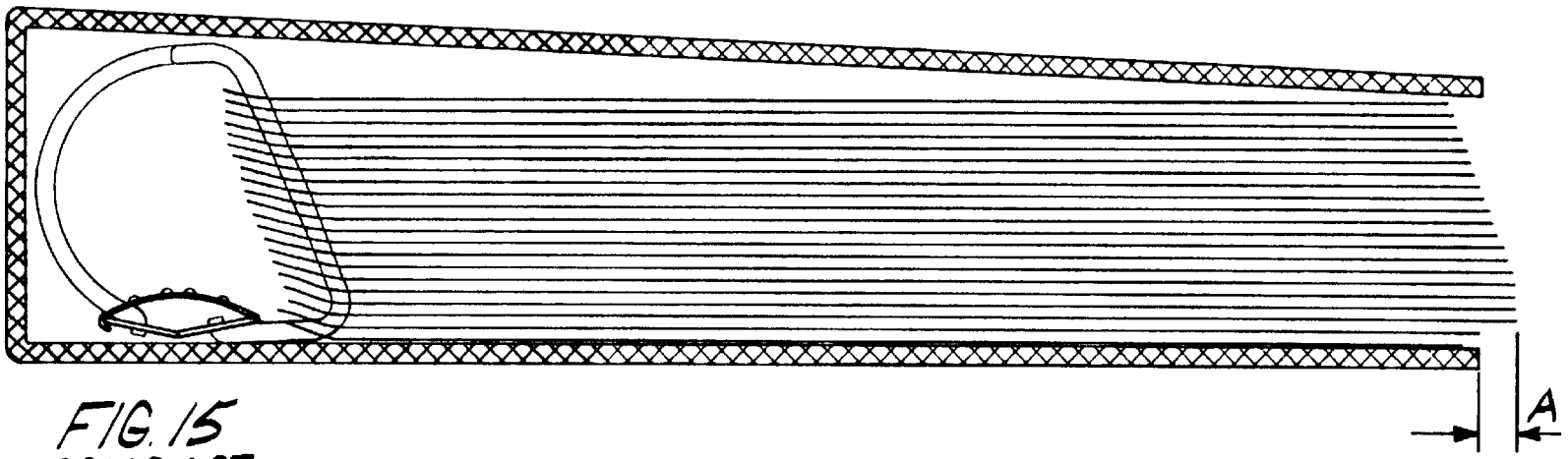
FIG. 15 PRIOR ART
FIG. 15 is a view showing an angle D-ring binder mechanism of the prior art.
Figure 16:
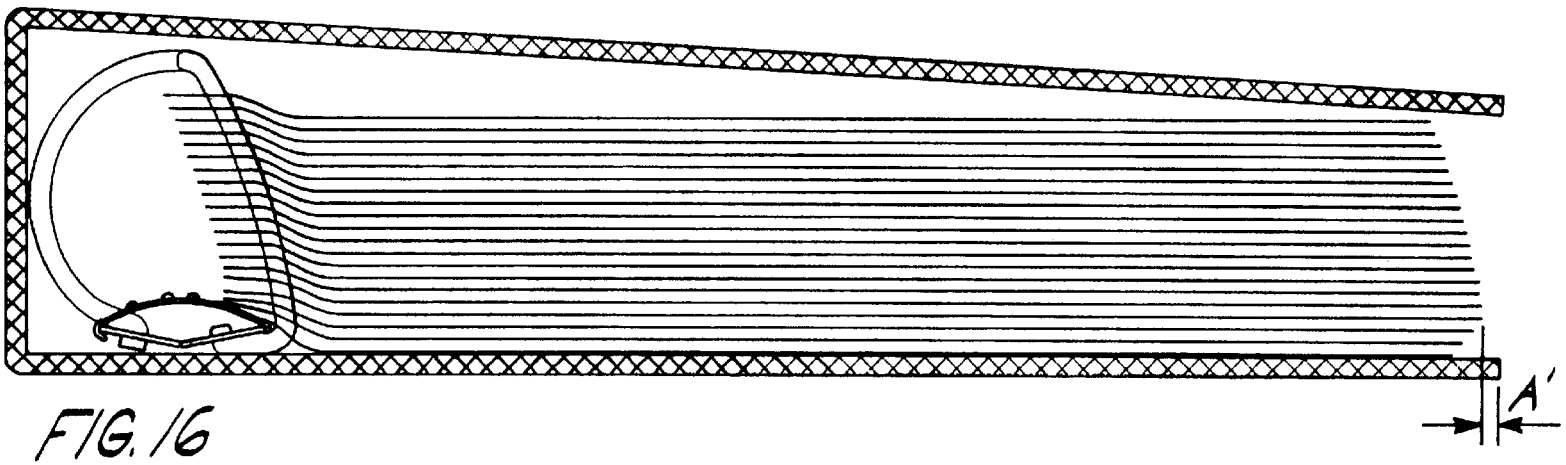
FIG. 16 is a view showing the second embodiment of the present invention mounted in a binder cover.
Figure 17:
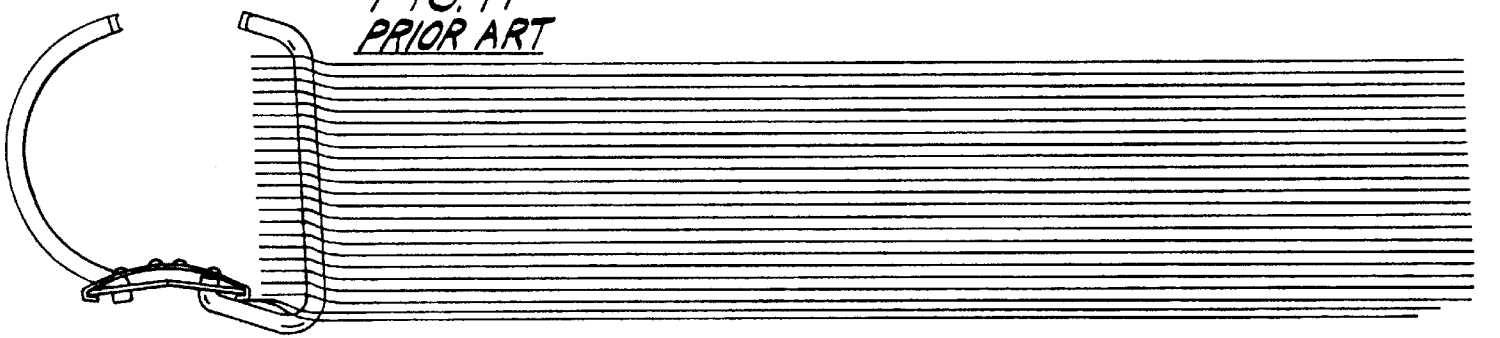
FIG. 17 PRIOR ART
FIG. 17 shows an angle D-ring binder mechanism of the prior art in the open position.
Figure 17A:
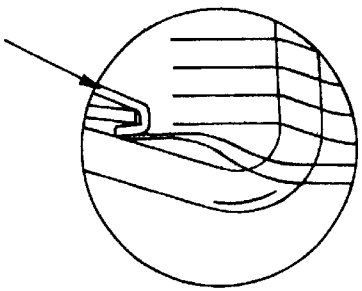
FIG. 17*a* is an enlarged view of a portion of the binder mechanism of FIG. 17.
Figure 18:
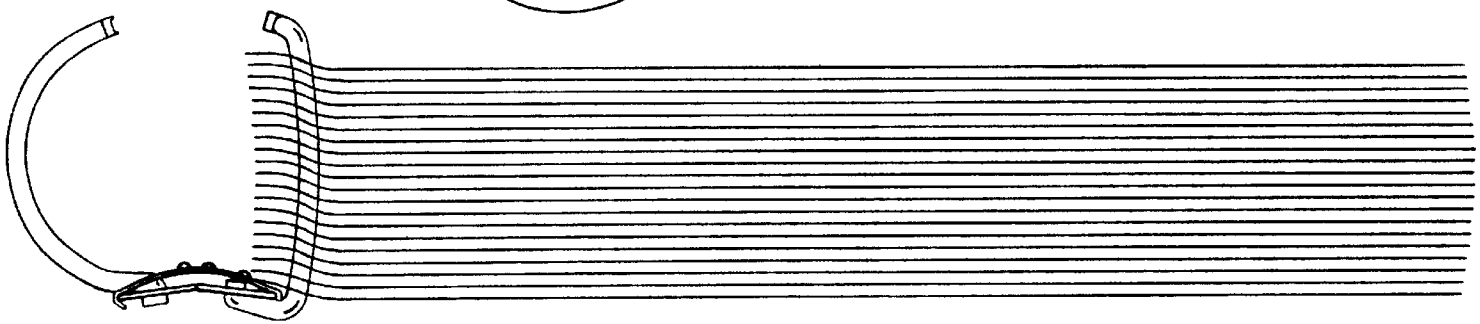
FIG. 18 is a view of the second embodiment of the present invention with the rings in the open position with loose-leaf pages mounted in it.
Figure 19:
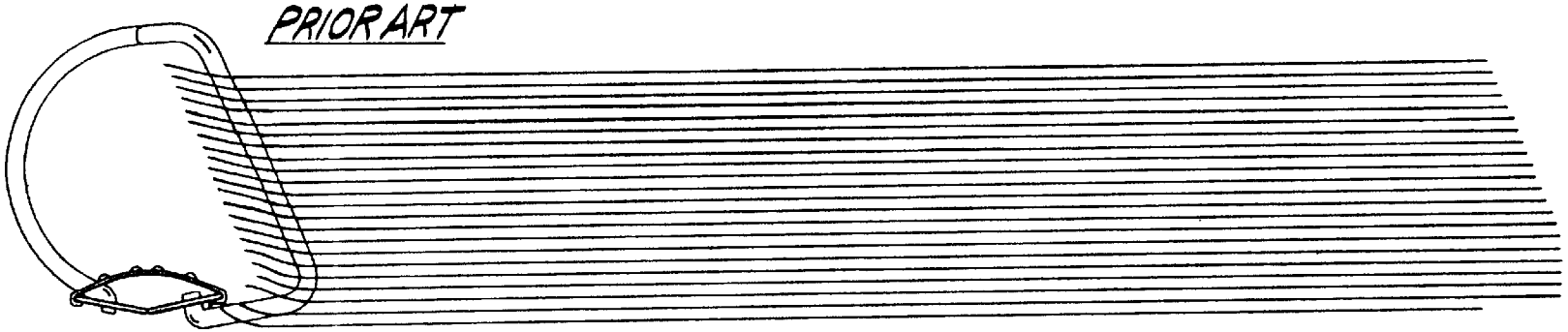
FIG. 19 PRIOR ART
FIG. 19 shows a prior art angle D-ring binder mechanism with the rings in the closed position.
Figure 19A:
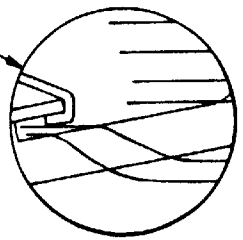
FIG. 19*a* is an enlarged view of a portion of FIG. 19.
Figure 20:
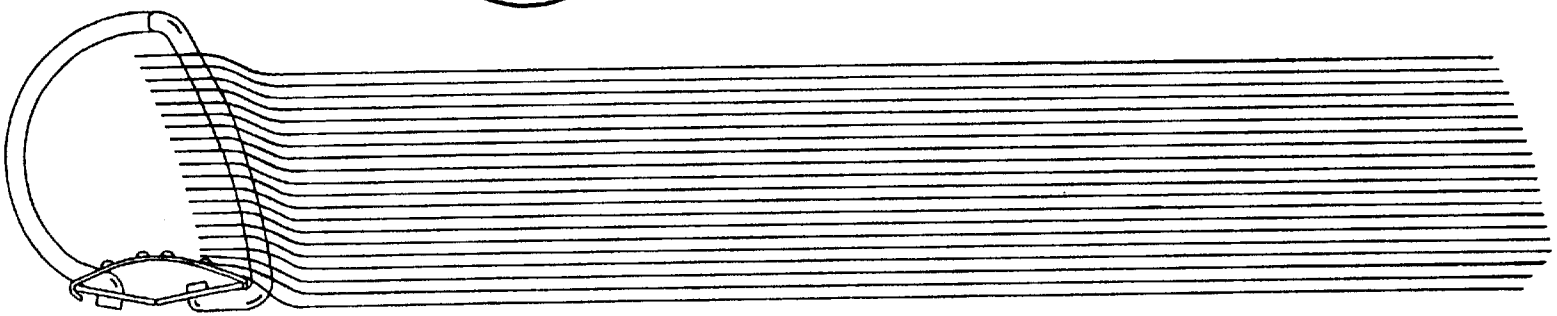
FIG. 20 is a view of the second embodiment of the present invention with the rings in the closed position and containing loose-leaf pages.
Figure 21:
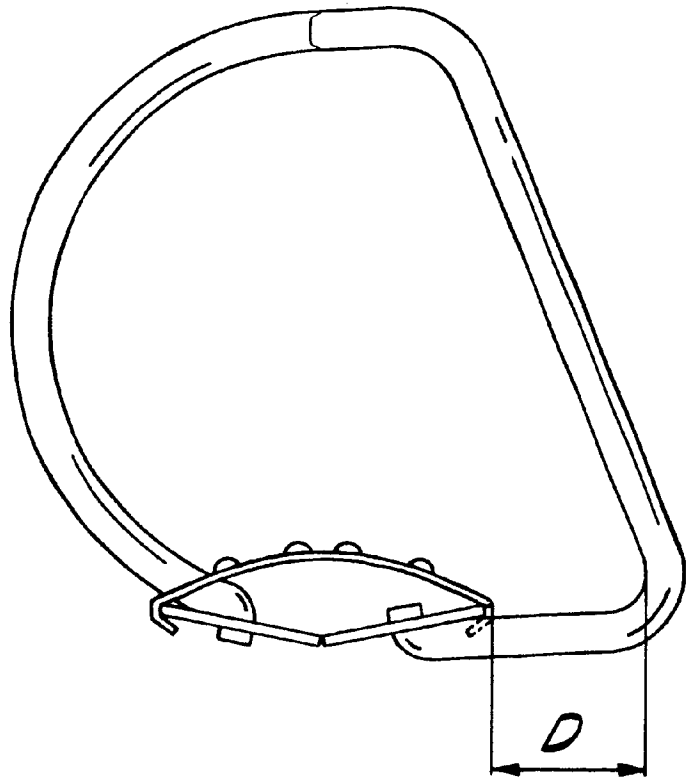
FIG. 21 PRIOR ART
FIG. 21 is a prior art angle D-ring binder mechanism enlarged and in the closed position.
Figure 22:
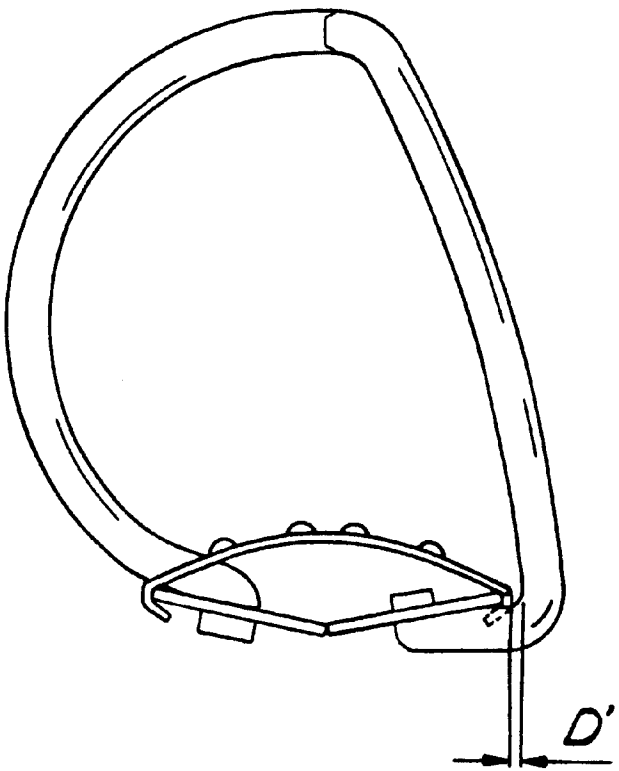
FIG. 22 is a view of a portion of the second embodiment of the present invention.

The advantages of the embodiments of the present invention are best seen by a comparison with the prior art as shown, for example, in FIGS. 15, 17 and 19 which illustrate a conventional angle D-ring with loose-leaf pages mounted on the ring. The D-ring of the second embodiment of the present invention is illustrated in FIGS. 16, 18, 20 and 22 for comparison, with loose-leaf pages contained therein. As shown by a comparison between FIGS. 15 and 16, the construction of the prior art D-ring causes the loose-leaf pages to either extend out of the binder, as shown in FIG. 15, or requires a longer binder such as by an amount A shown in FIG. 15 in order to contain the pages. This is because the angle D-ring of the prior art extends away from the upper plate member and the loose-leaf pages do not engage the upper surface of the upper plate member so therefore the binder must be longer. As illustrated with the second embodiment of the present invention as shown in FIG. 16, the loose-leaf pages rest on the upper surface of the upper plate member 12 and thus allow for the use of a shorter binder such as by amount A', which reduces material usage thus reducing the cost of manufacturing such binders. Furthermore, as illustrated in FIG. 17, the prior art angle D-rings permit loose-leaf pages to become jammed under the lateral edge of the upper plate member when the ring is in the open position as shown in FIG. 17, unlike the second embodiment of the present invention where the loose-leaf pages rest on top of the upper surface of the upper plate member 12 as shown in FIG. 18. Likewise, when the prior art angle D-ring binder is closed as illustrated in FIG. 19, the loose-leaf pages become jammed between the half-ring and the lateral edge of the upper plate member and can be damaged or distorted and cannot be moved around the ring as is desired since they are wedged between the ring and the upper plate member, unlike the second embodiment of the present invention as illustrated in FIG. 20 where the lower pages rest on top of the upper surface of the upper plate member 12 and are prevented from being jammed or distorted as with the prior art. Again, as illustrated in a comparison of FIGS. 21 and 22, the distance D in the prior art angle D-ring of FIG. 21 is substantially greater than the distance D' of the second embodiment of the present invention as shown in FIG. 22 so that the jamming and distortion possible with prior art devices cannot occur with the present invention. In addition, the material necessary to form a binder can be reduced with the present invention since the loose-leaf pages rest partially on top of the upper plate member.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A ring binder mechanism adapted to be secured to a base member, comprising a substantially rigid upper member having a continuous arcuate cross-section with a continuous lateral straight edge substantially throughout its length and supporting a pair of pivotable lower members to which a plurality of pairs of respective half-ring members are secured and wherein the pivotable members are pivotably movable between a first position in which the pairs of half-ring members are closed and a second position in which the pairs of half-ring members are open and wherein at least one of the half-ring members of each pair has a lower portion adjacent the upper member substantially in abutment with the lateral straight edge of the upper member when the pairs of half-ring members are in the first position.

2. A ring binder mechanism as claimed in claim 1 and further including said lateral edge of the upper member being straight along substantially the entire length of the upper member.

3. A ring binder mechanism as claimed in claim 1 and further including the at least one of the half-ring members of each pair extends around the lateral edge of the upper member and beneath one of the pair of pivotal members.

4. A ring binder mechanism as claimed in claim 3 and further including the at least one of the half-ring members of each pair being secured to a bottom surface of the one of the pair of pivotal members.

5. A ring binder mechanism as claimed in claim 1 wherein the at least one of the half-ring members of each pair is substantially J-shaped.

6. A ring binder mechanism as claimed in claim 1 wherein the at least one of the half-ring members of each pair is substantially arcuate shaped.

7. A ring binder mechanism as claimed in claim 1 wherein the at least one of the half-ring members of each pair is substantially J-shaped and the other is substantially arcuate.

8. A ring binder mechanism as claimed in claim 1 wherein both of the half-ring members of each pair are substantially arcuate shaped.

9. A ring binder mechanism adapted to be secured to a base member, comprising a substantially rigid upper member having a continuous arcuate cross-section and having a substantially straight lateral edge along substantially its entire length and wherein the upper member supports a pair of pivotable lower members to which a plurality of pairs of respective half-ring members are secured and wherein the pivotable members are pivotably movable between a first position in which the pairs of half-ring members are closed and a second position in which the pairs of half-ring members are open and wherein at least one of the half-ring members of each pair has a lower portion disposed outwardly of and closely adjacent the straight lateral edge of the upper member when the pairs of half-ring members are in the first position.

10. A ring binder mechanism as claimed in claim 9 wherein the lower portion of the at least one of the half-ring members of each pair is so positioned and arranged as to prevent the edges of paper sheets positioned in the binder mechanism from passing between the lower portion of the at least one half-ring members and the lateral edge of the ring member.

11. A ring binder mechanism as claimed in claim 10 and further including the at least one of the half-ring members of each pair extends around the lateral edge of the upper member and beneath one of the pair of pivotal members.

12. A ring binder mechanism as claimed in claim 11 and further including the at least one of the half-ring members of each pair being secured to a bottom surface of the one of the pair of pivotal members.

13. A ring binder mechanism as claimed in claim 9 wherein the at least one of the half-ring members of each pair is substantially J-shaped.

14. A ring binder mechanism as claimed in claim 9 wherein the at least one of the half-ring members of each pair is substantially arcuate shaped.

15. A ring binder mechanism as claimed in claim 9 wherein the at least one of the half-ring members of each pair is substantially J-shaped and the other is substantially arcuate.

16. A ring binder mechanism as claimed in claim 9 wherein both of the half-ring members of each pair are substantially arcuate shaped.

* * * * *